US005078524A

United States Patent [19]

Sato

[11] Patent Number: 5,078,524

[45] Date of Patent: Jan. 7, 1992

[54] PAPER RETAINING MECHANISM

[75] Inventor: Hiroyuki Sato, Tokyo, Japan

[73] Assignee: Seikosha Co., Ltd., Tokyo, Japan

[21] Appl. No.: 740,646

[22] Filed: Jul. 31, 1991

Related U.S. Application Data

[63] Continuation of Ser. No. 416,893, Oct. 4, 1989, abandoned.

[30] Foreign Application Priority Data

Oct. 20, 1988 [JP] Japan ..... 63-265045

[51] Int. Cl.[5] ..... B41J 13/02

[52] U.S. Cl. ..... 400/636.1; 400/639.1

[58] Field of Search ..... 400/638, 639, 639.1, 400/639.2, 645.2, 645.3, 636, 636.1, 636.2, 636.3, 637, 637.1, 637.2

[56] References Cited

U.S. PATENT DOCUMENTS

| | | | |
|---|---|---|---|
| 1,150,345 | 8/1915 | Dennis | 400/638 |
| 1,516,532 | 11/1924 | Hess | 400/639.2 |
| 1,632,362 | 6/1927 | Armstead | 400/645.3 |
| 1,840,817 | 1/1932 | Lear | 400/639.2 |
| 2,327,423 | 8/1943 | Helmond | 400/639.2 |
| 2,713,932 | 7/1955 | Letterman | 400/639.2 |
| 2,746,590 | 5/1956 | Lemos | 400/639.2 |
| 2,930,468 | 3/1960 | Israelson | 400/639.2 |
| 4,498,795 | 2/1985 | Tatara | 400/636.1 |
| 4,602,883 | 7/1986 | Ozawa et al. | 400/639.1 |
| 4,657,420 | 4/1987 | Kondo | 400/638 |
| 4,693,621 | 9/1987 | Kawaguchi | 400/639.1 |
| 4,714,364 | 12/1987 | Takada | 400/639.1 |
| 4,832,519 | 5/1989 | Fujimoto | 400/639.1 |
| 4,859,099 | 8/1989 | Kanemoto et al. | 400/636.1 |
| 4,883,375 | 11/1989 | Karube | 400/638 |
| 4,941,762 | 7/1990 | Murakami et al. | 400/636.1 |

FOREIGN PATENT DOCUMENTS

| | | | |
|---|---|---|---|
| 936543 | 7/1948 | France | 400/639.2 |
| 938401 | 9/1948 | France | 400/639.2 |
| 0073971 | 4/1987 | Japan | 400/639.1 |
| 133222 | 8/1929 | Switzerland | 400/639.2 |

OTHER PUBLICATIONS

"Selectable Bail Pressure", IBM Technical Disclosure Bulletin, vol. 25, 6–82, p. 199.

*Primary Examiner*—Eugene H. Eickholt
*Attorney, Agent, or Firm*—Jordan and Hamburg

[57] ABSTRACT

A paper retaining mechanism includes a support structure supporting a platen, a carriage mounted on the support structure for movement parallel to the platen to an end position, and a paper retaining device which includes a lever rotatably mounting a paper retaining roller. The lever is pivotably mounted on the support structure for pivotable movement between a first position in which the roller is spaced from the platen and a second position in which the roller is engageable with the platen. A bisaing spring is disposed between the lever and the support structure and operable to bias the lever in the first and second positions. The carriage is moveable to its end position to operably engage the paper retaining device and effect movement of the lever from the second to the first position in which the biasing spring biasingly urges the roller against the platen.

8 Claims, 2 Drawing Sheets

PAPER RETAINING MECHANISM

This application is a continuation, of application Ser. No. 07/416,893, filed Oct. 4, 1989 now abandoned.

BACKGROUND OF THE INVENTION

The present invention relates to a paper retaining mechanism used in a printer or the like.

In some conventional paper retaining mechanisms used for example in a printer, a paper retaining roller is kept separated from a platen by means of an operation lever which projects outwardly and which is rocked manually prior to commencing printing so as to have the paper retaining roller contact the platen elastically. In some other conventional mechanisms, a pushbutton is pressed at the time of commencing printing so as to operate a solenoid, thereby causing the paper retaining roller to contact the platen elastically.

There have been drawbacks in such conventional arrangements in that it is troublesome to operate the paper retaining lever manually and the cost is increased when a solenoid is employed.

It is therefore an object of the present invention to eliminate the complexity of manual operation by a simple construction without increasing the cost.

SUMMARY OF THE INVENTION

In order to achieve the above-mentioned objects, there is provided, according to the present invention, a paper retaining mechanism which includes a printing head mounted on a carriage moveable parallel to a platen, a paper retaining lever on which a shaft of a paper retaining roller capable of contacting the platen elastically is supported, and a biasing member which is capable of changing over resiliently from a first position where the paper retaining roller contacts the platen elastically to a second position where the paper retainer roller is separated from the platen. When the printing head is moved to one end portion, the printing head or the carriage is engaged directly or indirectly, thus making it possible to change over the paper retaining lever located at the second position to the first position.

BRIEF DESCRIPTION OF THE DRAWINGS

The drawings show an embodiment according to the present invention wherein.

DESCRIPTION OF THE PREFERRED EMBODIMENTS

An embodiment of the present invention will be described with reference to the accompanying drawings.

Figure 1:
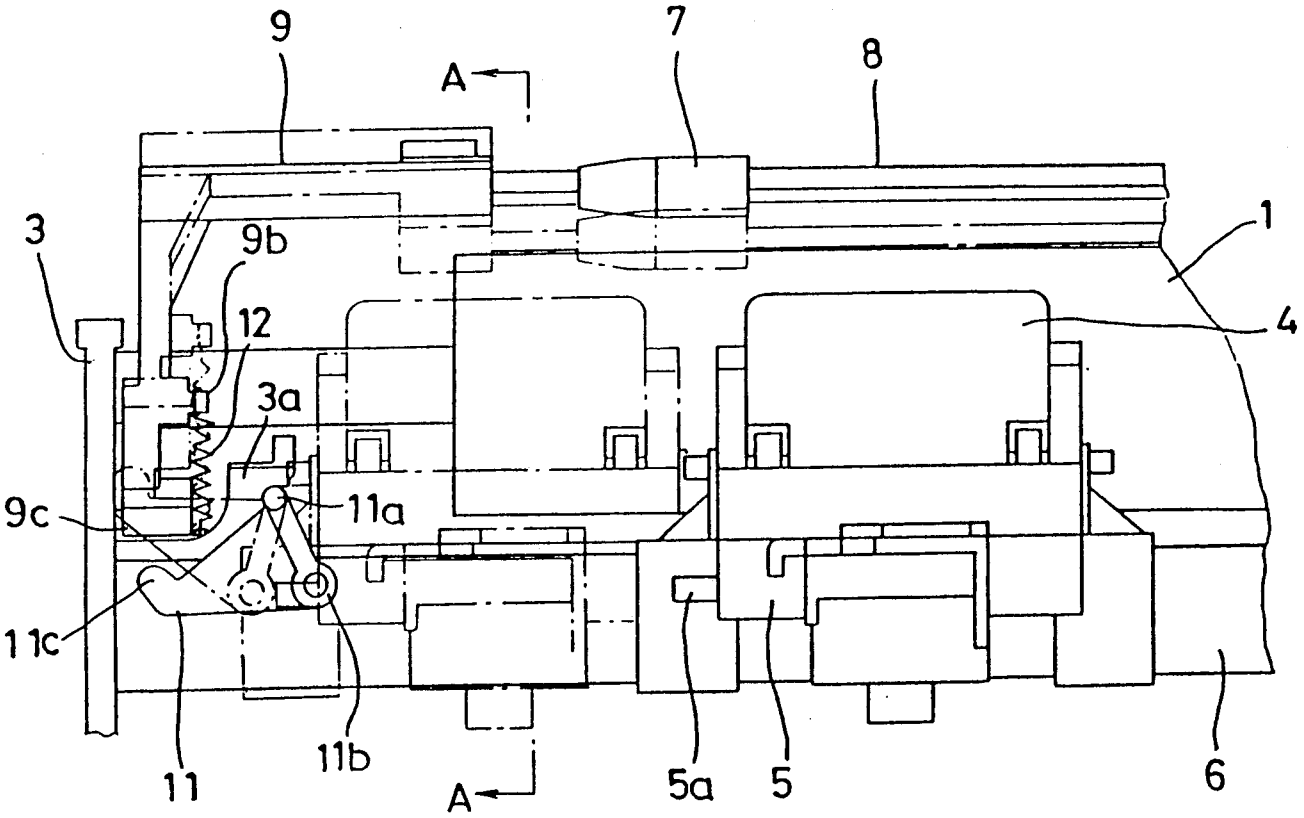
FIG. 1 is a front view of a paper retaining mechanism according to one embodiment of the present invention.

As shown in FIG. 1, a platen 1 which is driven to rotate at the time of form feed is fixedly secured to a shaft 2, and the shaft 2 is rotatably supported on a side plate 3. A printing head 4 is mounted on a carriage 5 so as to move reciprocatingly in left and right horizontal directions along a guide member 6 which is parallel to the platen 1. A paper retaining roller 7 which is capable of contacting the platen 1 elastically is provided rotatably on a paper retaining shaft 8, and one end portion of the paper retaining shaft 8 is supported by a paper retaining lever 9. The paper retaining lever 9 is pivotably or rockably mounted on the stationary member 3 to pivot about a pivot 9*a* (shown in FIG. 2). The paper retaining lever 9 is rockable between a first position (shown in chain lines in FIG. 1 and FIG. 2) where the paper retaining roller 7 contacts the platen 1 elastically and a second position (shown in solid lines in FIG. 1 and FIG. 2) where the paper retaining roller 7 is separated from the platen 1.

The paper retaining lever 9 is rocked from the second position toward the first position when the printing head 4 is moved to one end portion (the vicinity of the side plate 3 in the present embodiment) after a recording paper (not shown) is inserted between the printing head 4 and the platen 1 and fed to a position where it may contact the paper retaining roller 7. The rocking is effected by a rockable member 11 in the present embodiment.

The rockable member 11 has a front face having an almost triangular shape and is supported rockably on a supporting arm 3*a* provided integrally with the stationary member 3 by means of llb is provided at an end portion of the rockable member 11 on the side opposing the printing head 4. A projection 5*a* is provided on the carriage 5, and the projection 5*a* engages the abutment 11*b* so as to rock the rockable member 11 when the printing head 4 is moved to one end position. At another end portion of the rockable member 11, a pressing portion 11*c* which is engageable with the paper retaining lever 9 is formed. The pressing portion 11*c* is located under an engaging portion 9*c* projecting from the paper retaining lever 9.

A coil spring 12 utilized as a biasing means is hooked between the paper retaining lever 9 and the side plate 3. The coil spring 12 reverses the direction of bias of the paper retaining lever 9 in accordance with the rocking angle of the paper retaining lever 9, and the paper retaining lever 9 is changed over between the first position and the second position resiliently by the coil spring 12. The coil spring 12 can be stretched on both sides of the pivot 9*a* which is the rocking center of the paper retaining lever 9. The end portions of the coil spring 12 are fastened to a hook 9*b* of the paper retaining lever 9 and a hook 3*b* of the stationary member 3, respectively. The coil spring 12 rocks across the pivot 9*a* which is the rocking center interlocking with the rocking of the paper retaining lever 9. A stopper 13 projects from the stationary member 3 in order to restrict the retreat position of the paper retaining lever 9.

The operation is as follows. Before the recording paper is inserted between the printing head 4 and the platen 1 and fed to a position where it may contact the paper retaining roller, the paper retaining lever 9 is located at the second position (shown in solid lines in FIG. 1 and FIG. 2) and the paper retaining roller 7 is separated from the platen 1. At this time, the coil spring 12 urges the paper retaining lever 9 in a direction to separate the paper retaining lever 9 from the platen 1, that is in a counterclockwise direction in FIG. 2, and the paper retaining lever 9 contacts the stopper 13 to elastically retain the retaining lever 9 against the stopper 13.

When the recording paper is fed to a position where it can contact the paper retaining lever 7, the printing head 4 is moved to one end position. As a result, the projection 5*a* of the carriage 5 engages the abutment 11*b* of the rockable member 11, thereby causing the rockable member 11 to rock with the shaft 11*a* as the center and to move the pressing portion 11*c* upwardly.

Figure 2:
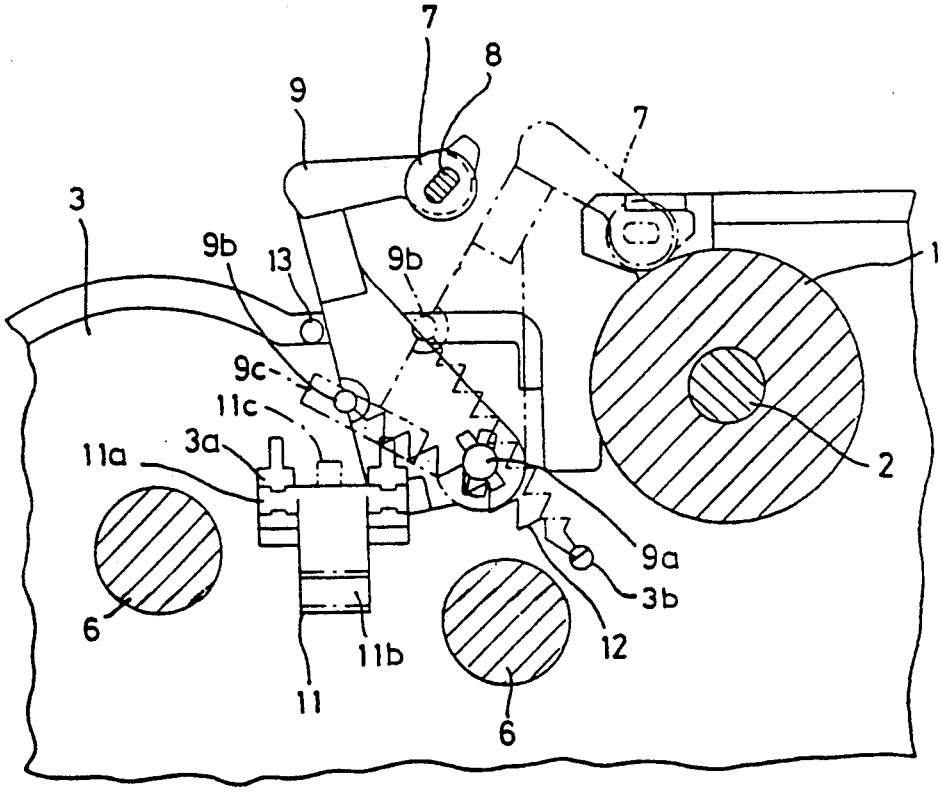
FIG. 2 is a cross-sectional view taken along the line A—A of FIG. 1.

With this, the pressing portion 11c engages the engaging portion 9c of the paper retaining lever, thereby pushing the engaging portion 9c upwardly and causing the paper retaining lever 9 to rock towards the platen 1. At the early stage of this rocking, the paper retaining lever 9 rocks clockwise as shown in FIG. 2 against the counter-clockwise urging force of the coil spring 12. However, after the coil spring 12 crosses the pivot 9b which is the rocking center whenever it is rocked, the direction of bias of the paper retaining lever 9 by the coil spring 12 is reversed, and it is then biased clockwise as shown in FIG. 2 toward the platen 1. Thus the paper retaining lever 9 is changed over from the second position to the first position resiliently and the paper retaining roller 7 resiliently contacts the platen 1.

When the paper retaining roller 7 is to be separated from the platen, the paper retaining lever 9 is operated manually so as to be moved from the first position to the second position. At this time, the operation is performed so that reversing of the biasing force of abovementioned biasing member 12 provides an appropriate click feeling.

The changeover means is not limited to the embodiment described hereinbefore, but may be constructed so that the projection provided on the printing head and the rockable member engage each other. Also, it is posible to provide a construction in such a manner that, for example, in order to rock the paper retaining lever directly by means of the projection provided on the printing head or the carriage, an inclined surface is provided on one engaging portion of the paper retaining lever and the projection so that the paper retaining lever is rocked by being guided by the inclined surface when both are engaged with each other. Furthermore, the biasing means is not limited to the coil spring such as shown, but it is feasible to use an ohm spring for instance.

As described above, according to the present invention, the paper retaining lever rocks automatically thereby causing the paper retaining roller to contact the platen elastically when the printing head is moved to an end position. Thus, the disadvantage of having the paper retaining roller contact the platen elastically by manual operation is eliminated and, moreover, the construction is simple. Therefore the cost will be reduced.

What I claim is:

1. A paper retaining mechanism comprising:

a support means supporting a platen;

carriage means mounted on said support means for movement parallel to said platen to an end position;

a paper retaining means cmoprising a lever rotatably mounting a paper retaining roller, said lever being pivotably mounted on said support means for pivotable movement about a pivot axis between a first position where said roller is spaced from said platen and a second position where said roller is engageable with said platen; and biasing means disposed between said lever and said support means and operable to bias said lever in said first and second positions, said biasing means comprising an elongated biasing means which is disposed on one side of said pivot axis when said lever is in said first position to biasingly urge and retain said lever in said first position, said biasing means being disposed on an opposite side of said pivot axis when said lever is in said second position to biasingly urge and retain said lever in said second position;

said carriage being moveable to said end position to operably engage said paper retaining means and effect movement of said lever from said first to said second position in which said biasing means biasingly urges said roller against said platen.

2. A paper retaining mechanism according to claim 1, wherein said carriage means comprises engageable means engageable with said paper retaining means when said carriage means is moved to said end position.

3. A paper retaining mechanism according to claim 1, wherein said carriage means comprises a carriage structure and a printer carried on said carriage structure.

4. A paper retaining mechanism according to claim 1, wherein said paper retaining means is disposed in the path of travel of said carriage means as said carriage means moves parallel to said platent such that when said carriage means moves to said end position, said carriage means engages said paper retaining means to actuate said lever for movement from said first to said second position.

5. A paper retaining mechanism according to claim 1, wherein said paper retaining means further comprises a rockable member engaged by said carriage means when said carriage means is moved to said end position said rockable member being engageable with said lever to initiate pivoting of said lever from said second to said first position.

6. A paper retaining mechanism according to claim 1, wherein said biasing means comprises a spring having one end connected to said lever and the other end connected to said support means, said spring being under tension in urging said lever in each of said first and second positions.

7. A paper retaining mechanism according to claim 6, wherein said second position is designated a paper-retaining position and said first position is designated a non-paper-retaining position, said spring having an elongate spring axis, said spring axis being disposed in one tensioned position on one side of said pivot axis when said lever is in said paper-retaining position, said spring axis being disposed in a second tensioned position on the opposite side of said pivot axis when said lever is in said non-paper-retaining position, said spring means moving through an intermediate position in which said spring axis is aligned with said pivot axis when said spring means passes between said paper-retaining position and said non-paper-retaining position.

8. A paper retaining mechanism for a printer or the like comprising:

a carriage provided movably in parallel with a platen;

a printing head mounted on said carriage;

a paper retaining lever on which a shaft of a paper retaining roller capable of contacting said platen is supported;

said paper retaining lever being rotatably mounted on a pivot to be changeable from and to a first position where said paper retaining roller contacts said platen and from and to a separate second position;

said paper retaining lever being preloaded by a biasing member biasing said paper retaining lever towards the first and second positions respectively;

said biasing member being engaged between a hook provided on said paper retaining lever and a stationary hook such that said hook is positioned on one said of a line passing through the center of said pivot and the center of said stationary hook while said paper retaining lever is in the first position, and on the other side of said line while it is in said second position, such that when said paper retaining lever is moved to said second position, said lever is maintained there only by the urging force of said biasing member, and that when said lever is in its second position and said printing head is moved into its one end position, engagement means engages said paper retaining lever so that the paper retaining lever is automatically switched over by the engagement into the first position.

* * * * *